US010328728B2

(12) United States Patent
Takagi et al.

(10) Patent No.: US 10,328,728 B2
(45) Date of Patent: Jun. 25, 2019

(54) IMAGE RECORDING APPARATUS AND IMAGE RECORDING METHOD FOR PRINTING EACH OF A PLURALITY OF UNIT IMAGES

(71) Applicant: SCREEN HOLDINGS CO., LTD., Kyoto (JP)

(72) Inventors: Keita Takagi, Kyoto (JP); Toshio Maeda, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/549,566

(22) PCT Filed: Dec. 18, 2015

(86) PCT No.: PCT/JP2015/085461

§ 371 (c)(1),
(2) Date: Aug. 8, 2017

(87) PCT Pub. No.: WO2016/129178

PCT Pub. Date: Aug. 18, 2016

(65) Prior Publication Data

US 2018/0037037 A1 Feb. 8, 2018

(30) Foreign Application Priority Data

Feb. 9, 2015 (JP) ..... 2015-022816

(51) Int. Cl.
*B41J 2/01* (2006.01)
*B41J 11/42* (2006.01)
(Continued)

(52) U.S. Cl.
CPC ..... *B41J 11/42* (2013.01); *B41J 2/01* (2013.01); *B41J 11/46* (2013.01); *B41J 25/308* (2013.01); *B41J 15/04* (2013.01)

(58) Field of Classification Search
CPC ..... B41J 2/01; B41J 11/42; B41J 25/308
See application file for complete search history.

(56) References Cited

U.S. PATENT DOCUMENTS

2002/0001006 A1* 1/2002 Matsumoto ..... B41J 11/008 347/16
2011/0279510 A1 11/2011 Takeuchi et al.
(Continued)

FOREIGN PATENT DOCUMENTS

JP S57-178780 A 11/1982
JP S62-105658 A 5/1987
(Continued)

OTHER PUBLICATIONS

International Search Report issued in Application No. PCT/JP2015/085461 dated Mar. 8, 2016, with English translation.
(Continued)

*Primary Examiner* — Bradley W Thies
(74) *Attorney, Agent, or Firm* — McDermott Will & Emery LLP

(57) ABSTRACT

This image recording apparatus includes recording heads and a detector for detecting a thick part of a recording medium. Before the thick part reaches a recording region, printing by means of the recording heads is stopped, and the relative position of the recording heads and the recording region is switched to a retracted position in the image recording apparatus. After the thick part passes through the recording region, the relative position of the recording heads and the recording region is switched to a printing position, and the printing of a new unit image is started from a position an integral multiple of a printing period apart from a last start position. This restrains a difference between the periods of image recording positions before and after the
(Continued)

suspension of a printing step while restraining contact between the recording heads and the thick part.

12 Claims, 5 Drawing Sheets

(51) Int. Cl.

| | |
|---|---|
| ***B41J 11/46*** | (2006.01) |
| ***B41J 15/04*** | (2006.01) |
| ***B41J 25/308*** | (2006.01) |

(56) References Cited

U.S. PATENT DOCUMENTS

| | | | | |
|---|---|---|---|---|
| 2012/0199022 | A1 | 8/2012 | Shishido et al. | |
| 2014/0198148 | A1 | 7/2014 | Imamura | |
| 2016/0136949 | A1* | 5/2016 | Kojima | B41J 2/04503 347/8 |

FOREIGN PATENT DOCUMENTS

| | | | |
|---|---|---|---|
| JP | S64-053884 | A | 3/1989 |
| JP | 2002-046260 | A | 2/2002 |
| JP | 2005-231062 | A | 9/2005 |
| JP | 2011-240491 | A | 12/2011 |
| JP | 2012-143944 | A | 8/2012 |
| JP | 2012-162032 | A | 8/2012 |
| JP | 2013-039684 | A | 2/2013 |
| JP | 2014-136343 | A | 7/2014 |

OTHER PUBLICATIONS

Extended European Search Report issued in corresponding European Patent Application No. 15882052.2-1019, dated Sep. 13, 2018.
Japanese Office Action issued in corresponding Japanese Patent Application No. 2015-022816, dated Jan. 8, 2019, with English Translation.

* cited by examiner

IMAGE RECORDING APPARATUS AND IMAGE RECORDING METHOD FOR PRINTING EACH OF A PLURALITY OF UNIT IMAGES

RELATED APPLICATIONS

This application is the U.S. National Phase under 35 U.S.C. § 371 of International Application No. PCT/JP2015/085461, filed on Dec. 18, 2015, which in turn claims the benefit of Japanese Application No. 2015-022816, filed on Feb. 9, 2015, the disclosures of which are incorporated by reference herein.

TECHNICAL FIELD

The present invention relates to an image recording apparatus and an image recording method.

BACKGROUND ART

An image recording apparatus for recording images on an elongated strip-shaped recording medium and what is called a post-processing machine for processing the elongated strip-shaped recording medium on which images are recorded by the image recording apparatus have heretofore been known. In such an image recording apparatus, multiple independent images are sequentially printed in a longitudinal direction of the recording medium. Examples of the post-processing machine include another image recording apparatus for recording images on the back surface of the recording medium, a cutting apparatus for cutting the recording medium, a folding apparatus for folding the recording medium, and an half-cutting apparatus for cutting only a sticker layer of the recording medium comprised of a backing layer and the sticker layer.

Such a conventional image recording apparatus and such a conventional post-processing machine are disclosed in Japanese Patent Application Laid-Open No. 2002-46260, for example. An inkjet printer disclosed in Japanese Patent Application Laid-Open No. 2002-46260 includes an image recording part for recording images on elongated strip-shaped recording paper, and a cutting part for cutting the recording paper on which images are recorded (in paragraph 0011, and FIG. 1).

CITATION LIST

Patent Literature

Patent Literature 1: Japanese Patent Application Laid-Open No. 2002-46260

SUMMARY OF INVENTION

Technical Problem

Some elongated strip-shaped recording media are formed by joining a plurality of recording media together in a longitudinal direction thereof. Such an elongated strip-shaped recording medium has a splice part in which an upstream recording medium and a downstream recording medium are connected to each other with an adhesive agent, an adhesive tape or the like. The splice part is thicker than other parts of the recording medium. For this reason, there is apprehension that the splice part comes in contact with a recording head when the splice part passes near the recording head without changing the relative position of the recording head and the recording medium from that during printing.

For restraining contact between the splice part and the recording head, it is necessary that the step of printing by means of the recording head is suspended during the passage of the splice part near the recording head and that the relative position of the recording head and the recording medium is changed to a retracted position in which the splice part and the recording head are out of contact with each other.

However, the suspension of the printing poses a danger that the period of the recording positions of images on the recording medium after the restart of the printing does not coincide with the period of the recording positions of images before the suspension of the printing. If such a difference exists between the periods of the recording positions of the images before the suspension of the printing and after the restart of the printing, there arises a need to set a processing period again in the post-processing machine in accordance with the period of the recording positions of images recorded after the restart of the printing.

In view of the foregoing, it is an object of the present invention to provide a technique capable of restraining a difference between the periods of image recording positions before and after the suspension of the step of printing in an image recording apparatus for recording images on an elongated strip-shaped recording medium.

Solution to Problem

To solve the aforementioned problem, a first aspect of the present invention is intended for an image recording apparatus for printing each of a plurality of unit images for each predetermined printing period on an elongated strip-shaped recording medium while transporting the recording medium. The image recording apparatus comprises: a transport part for transporting the recording medium along a transport path; a recording head for ejecting droplets onto the recording medium disposed in a recording region on the transport path to print an image on the recording medium; a detector disposed upstream of the recording head and for detecting a thick part of the recording medium, the thick part being thicker than other parts of the recording medium; a relative position switching part for switching the relative position of the recording head and the recording region to a printing position and to a retracted position; a storage part for storing a last start position that is a start position of the last one of the unit images on the recording medium; and a controller for controlling the parts, the controller stopping the printing by means of the recording head and switching the relative position of the recording head and the recording region to the retracted position by means of the relative position switching part before the thick part reaches the recording region, the controller switching the relative position of the recording head and the recording region to the printing position by means of the relative position switching part and starting the printing of a new one of the unit images by means of the recording head from a position an integral multiple of the printing period apart from the last start position after the thick part passes through the recording region.

According to a second aspect of the present invention, in the image recording apparatus of the first aspect, the controller stops the printing by means of the recording head after one of the unit images being printed when the detector detects the thick part is printed completely to the end.

According to a third aspect of the present invention, in the image recording apparatus of the first or second aspect, the storage part stores therein a virtual last start position while the printing by means of the recording head is stopped, the virtual last start position becoming the last start position on the recording medium if the printing continues; and the controller restarts the printing of the unit images by means of the recording head from the position an integral multiple of the printing period apart from the last start position, based on the virtual last start position, when starting the printing of the new one of the unit images after the printing is stopped.

According to a fourth aspect of the present invention, in the image recording apparatus of any one of the first to third aspects, the controller makes the transport speed of the recording medium by means of the transport part lower than that during the printing and switches the relative position of the recording head and the recording region to the retracted position by means of the relative position switching part before the thick part reaches the recording region and after the printing by means of the recording head is stopped.

According to a fifth aspect of the present invention, in the image recording apparatus of any one of the first to fourth aspects, the controller switches the relative position of the recording head and the recording region to the printing position by means of the relative position switching part while the transport of the recording medium by means of the transport part is stopped after the thick part passes through the recording region.

According to a sixth aspect of the present invention, in the image recording apparatus of any one of the first to fifth aspects, the relative position switching part moves the recording head to thereby switch the relative position of the recording head and the recording region.

According to a seventh aspect of the present invention, in the image recording apparatus of any one of the first to fifth aspects, the transport part includes a plurality of platen rollers extending in a substantially horizontal direction orthogonal to the transport path and constituting the recording region; and the relative position switching part moves the platen rollers to thereby switch the relative position of the recording head and the recording region.

An eighth aspect of the present invention is intended for a method of recording an image, the method printing each of a plurality of unit images for each predetermined printing period by ejecting droplets from a recording head onto an elongated strip-shaped recording medium disposed in a recording region on an transport path while transporting the recording medium along the transport path. The method comprises the steps of: a) storing a last start position that is a start position of the last one of the unit images on the recording medium; b) detecting a thick part of the recording medium in a position upstream of the recording region, the thick part being thicker than other parts of the recording medium, the step b) being performed after the step a); c) stopping the printing by means of the recording head, the step c) being performed after the step b); d) switching the relative position of the recording head and the recording region from a printing position to a retracted position, the step d) being performed after the step c); e) switching the relative position of the recording head and the recording region from the retracted position to the printing position, the step e) being performed after the step d) and after the thick part passes through the recording region; and f) printing a new one of the unit images from a position an integral multiple of the printing period apart from the last start position, the step f) being performed after the step e).

According to a ninth aspect of the present invention, in the method of the eighth aspect, if one of the unit images is being printed when the thick part is detected in the step b), the one unit image being printed when the thick part is detected is printed completely to the end before the step c).

According to a tenth aspect of the present invention, in the method of the eighth or ninth aspect, in the step d), the transport speed of the recording medium is made lower than that during the printing, and the relative position of the recording head and the recording region is switched from the printing position to the retracted position.

According to an eleventh aspect of the present invention, in the method of any one of the eighth to tenth aspects, in the step e), the relative position of the recording head and the recording region is switched from the retracted position to the printing position while the transport of the recording medium is stopped.

Advantageous Effects of Invention

According to the first to tenth aspects of the present invention, in the image recording apparatus for recording an image on the elongated strip-shaped recording medium, a difference between the periods of image recording positions before and after the suspension of a printing step is restrained while the thick part of the recording medium is restrained from coming in contact with the recording head.

In particular, according to the second to fifth aspects and the ninth to eleventh aspects of the present invention, waste of the recording medium is reduced.

DESCRIPTION OF EMBODIMENTS

An embodiment according to the present invention will now be described with reference to the drawings. A direction in which printing paper is transported is referred to as a "transport direction", and a horizontal direction orthogonal to the transport direction is referred to as a "width direction" hereinafter.

<1. Configuration of Printing Apparatus>

Figure 1:
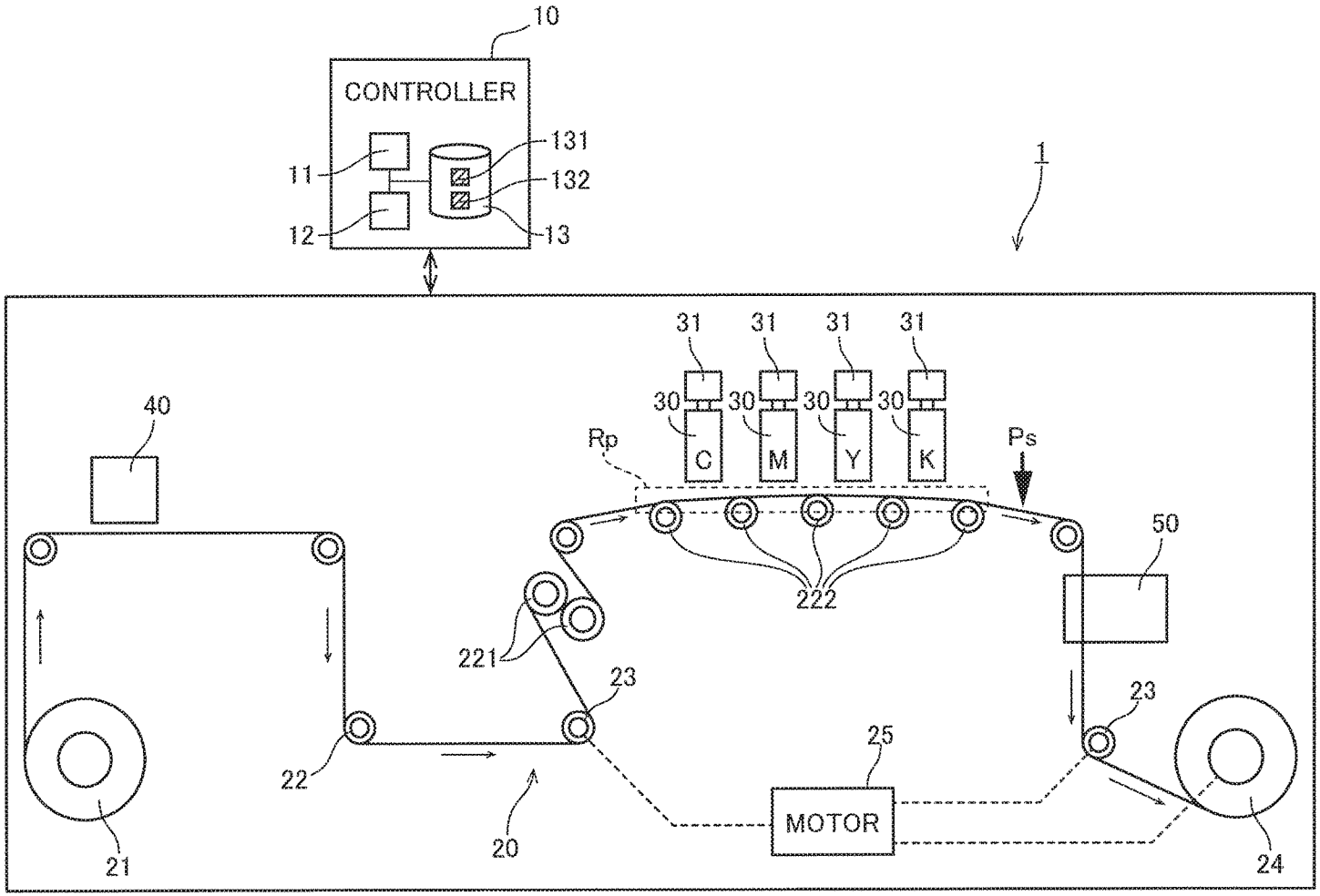
FIG. 1 is a view conceptually showing the configuration of a printing apparatus according to one embodiment.
Figure 2:
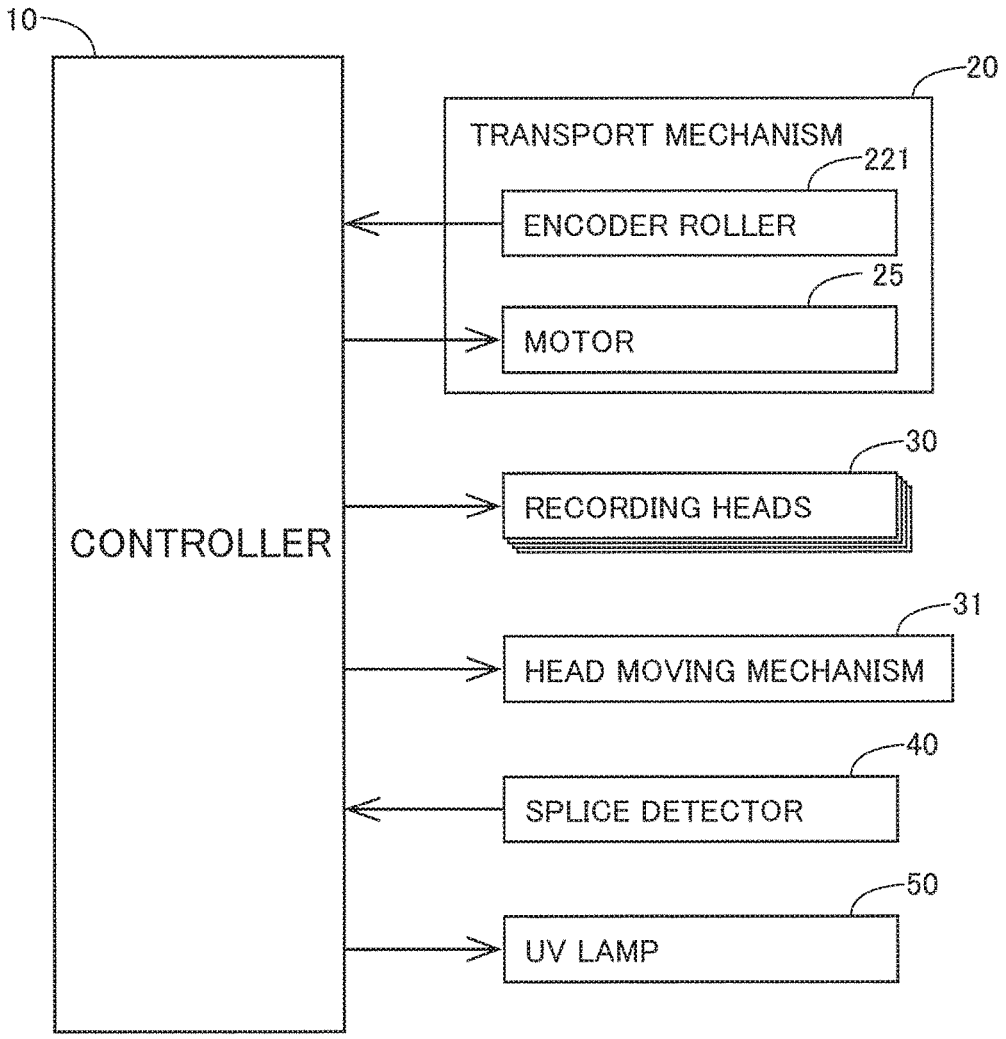
FIG. 2 is a block diagram showing a control system for the printing apparatus according to the one embodiment.

FIG. 1 is a view conceptually showing the configuration of a printing apparatus 1 according to one embodiment of the present invention. FIG. 2 is a block diagram showing a control system for the printing apparatus 1. This printing apparatus 1 is an inkjet printing apparatus which records color images on printing paper 9 that is an elongated strip-shaped recording medium by ejecting ink droplets from a plurality of recording heads 30 onto the printing paper 9 while transporting the printing paper 9.

This printing apparatus 1 prints each of a plurality of unit images for each predetermined printing period (predetermined distance) on the printing paper 9. The printing paper 9 on which the unit images are printed in the printing apparatus 1 is cut for each printing period or is creased near a boundary between the printing periods, for example, in a post-processing machine such as a cutting machine, a folding machine or the like.

As shown in FIG. 1, the printing apparatus 1 includes a transport mechanism 20, four recording heads 30, head moving mechanisms 31, a splice detector 40, a UV lamp 50 and a controller 10.

The transport mechanism 20 is a mechanism for transporting the printing paper 9 in the transport direction that is the longitudinal direction of the printing paper 9 while holding the printing paper 9. The transport mechanism 20 according to the present embodiment includes an unwinder 21, a plurality of transport rollers 22, two drive rollers 23 and a winder 24.

A motor 25 serving as a power source is coupled to the two drive rollers 23 and the winder 24 via belts. For controlling tension, the unwinder 21 is coupled to a brake (not shown). The drive rollers 23 and the winder 24 rotate when the controller 10 drives the motor 25. All of the transport rollers 22 according to the present embodiment are follower rollers which are not coupled to the motor 25 but rotate in accordance with the motion of the printing paper 9. At least one of the transport rollers 22 may be a drive roller coupled to the motor 25.

The transport rollers 22 constitute a transport path for the printing paper 9. Each of the transport rollers 22 rotates about a horizontal axis to guide the printing paper 9 downstream along the transport path. The printing paper 9 comes in contact with the transport rollers 22, so that tension is applied to the printing paper 9. In this manner, the printing paper 9 is unwound from the unwinder 21, and is transported along the transport path formed by the transport rollers 22 to the winder 24. After being transported, the printing paper 9 is wound and collected on the winder 24.

The transport rollers 22 include encoder rollers 221 and platen rollers 222. The encoder rollers 221 detect the transport speed and transport distance of the printing paper 9. The platen rollers 222 in positions opposed to the recording heads 30 support the printing paper 9. A region included in the transport path of the printing paper 9 and supported by the platen rollers 222 serves as an image recording region Rp. The positions of the platen rollers 222 constituting the recording region Rp are fixed in the present embodiment.

The four recording heads 30 are arranged in spaced apart relation in the transport direction over the transport path of the printing paper 9. The four recording heads 30 eject ink droplets of cyan (C), magenta (M), yellow (Y) and black (K), respectively, onto the upper surface of the printing paper 9 passing through the recording region Rp on the transport path.

The printing apparatus 1 according to the present embodiment is what is called a one-pass type recording apparatus which records a desired image pattern on the printing paper 9 by ejecting ink droplets from the recording heads 30 while the printing paper 9 passes under the recording heads 30 only once.

The lower surface of each of the recording heads 30 has a plurality of nozzles disposed in a two-dimensional array. The positions of the individual nozzles are shifted in the width direction, and each of the nozzles is assigned to a region having a width of one pixel on the printing paper 9.

The head moving mechanisms 31 are mechanisms for moving the positions of the respective recording heads 30 to a printing position and to a retracted position. During printing, the head moving mechanisms 31 place the respective recording heads 30 in the printing position in which the distance between the lower surfaces of the respective recording heads 30 and the printing paper 9 having an ordinary thickness and placed on the recording region Rp is 1 mm, for example.

During retraction, the head moving mechanisms 31 place the respective recording heads 30 in the retracted position in which the distance between the lower surfaces of the respective recording heads 30 and the printing paper 9 having the ordinary thickness and placed on the recording region Rp is 5 mm, for example. In this manner, the head moving mechanisms 31 constitute a relative position switching part for switching the relative position of the recording heads 30 and the recording region Rp to the printing position and to the retracted position.

Although the head moving mechanisms 31 are conceptually shown in FIG. 1, a variety of known mechanisms may be used to implement the head moving mechanisms 31. Specifically, a mechanism which moves the recording heads 30 upwardly and downwardly along a ball screw by rotating the ball screw with the power of a motor, for example, may be used.

The splice detector 40 is disposed upstream of the recording heads 30 and detects a splice part of the printing paper 9. The printing paper 9 is formed by joining a plurality of printing paper sheets together in a longitudinal direction thereof. For this reason, the printing paper 9 has a splice part in which an upstream printing paper sheet and a downstream printing paper sheet are connected to each other with an adhesive agent or an adhesive tape. That is, the splice part is a thick part thicker than other parts of the printing paper 9.

An ultrasonic sensor for sensing different values depending on the thickness and material of the printing paper 9 is used for the splice detector 40 according to the present embodiment. Thickness detecting devices other than the ultrasonic sensor may be used for the splice detector 40.

The UV lamp 50 is disposed downstream of the recording heads 30 and irradiates a printing surface of the printing paper 9 with ultraviolet light. Inks used in the present embodiment are UV curable inks. After the ejection of the inks onto the printing paper 9 in the recording region Rp, the irradiation of the corresponding part of the printing paper 9 with the ultraviolet light from the UV lamp 50 cures the inks to fix the inks on the printing paper 9.

The controller 10 controls the operations of the parts of the printing apparatus 1. As conceptually shown in FIG. 1, the controller 10 according to the present embodiment is formed by a computer including an arithmetic processor 11 such as a CPU, a memory 12 such as a RAM and a storage part 13 such as a hard disk drive. As shown in FIG. 2, the controller 10 is electrically connected to the encoder rollers 221 and the motor 25 in the transport mechanism 20, the recording heads 30, the head moving mechanisms 31, the splice detector 40 and the UV lamp 50.

The controller 10 temporarily reads a computer program 131 and data 132 which are stored in the storage part 13 onto the memory 12. The controller 10 causes the arithmetic processor 11 to perform arithmetic processing based on the computer program 131 and the data 132 which are temporarily read, thereby controlling the operations of the parts of the printing apparatus 1. Thus, a printing step in the printing apparatus 1 proceeds. The controller 10 may be formed by electronic circuitry.

<2. Suspension of Printing Step During Passage of Splice Part>

Figure 3:
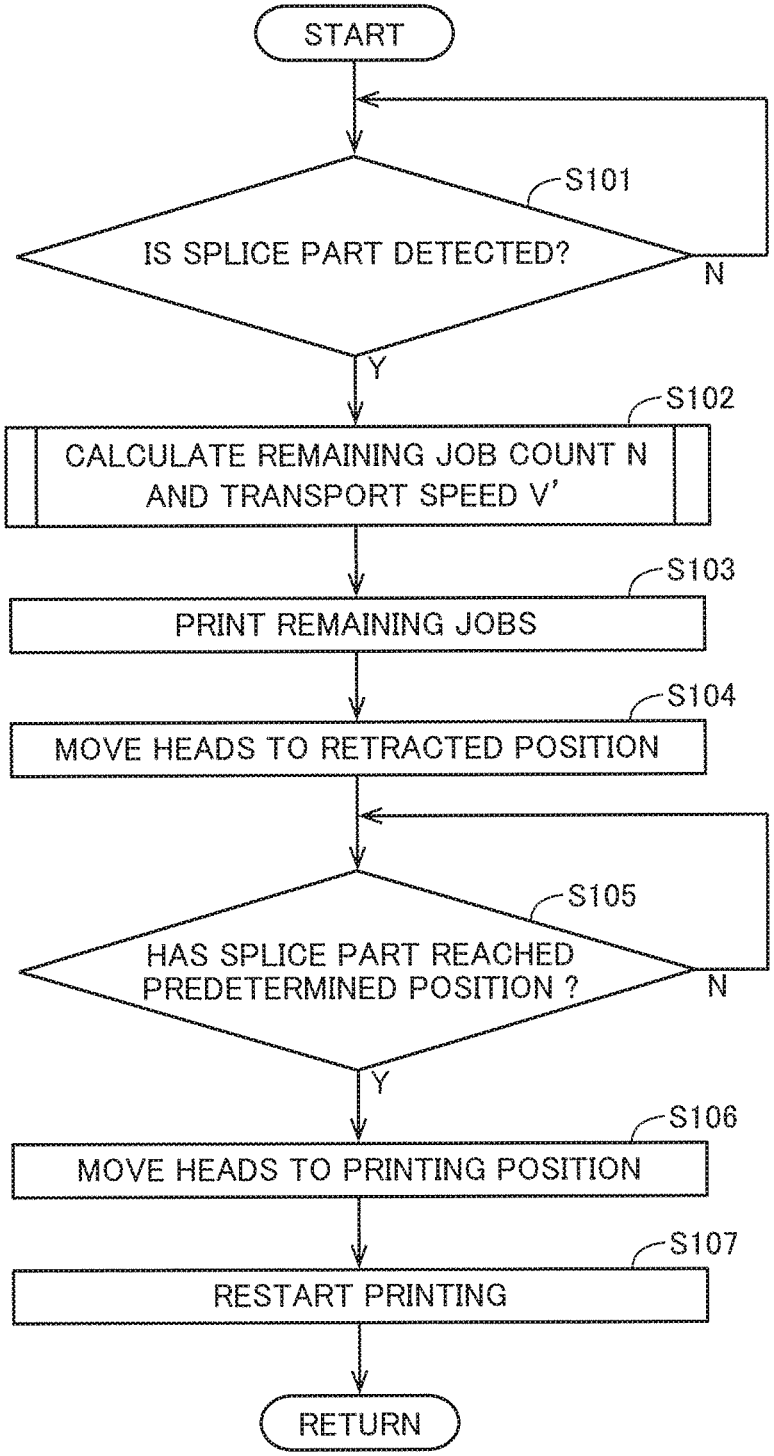
FIG. 3 is a flow diagram showing a procedure for a printing suspension step according to the one embodiment.
Figure 4:
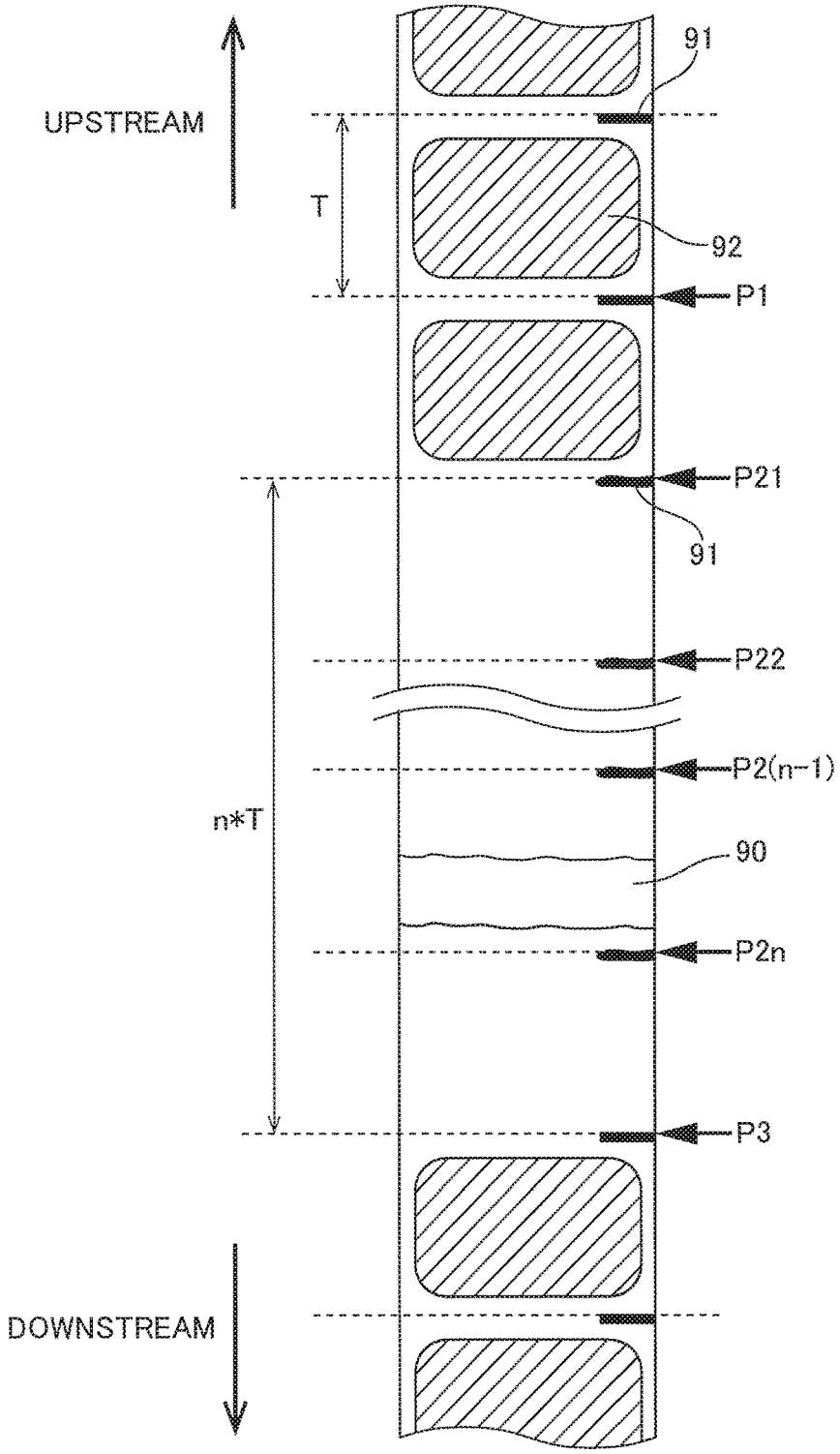
FIG. 4 is a view showing an example of printing paper according to the one embodiment.
Figure 5:
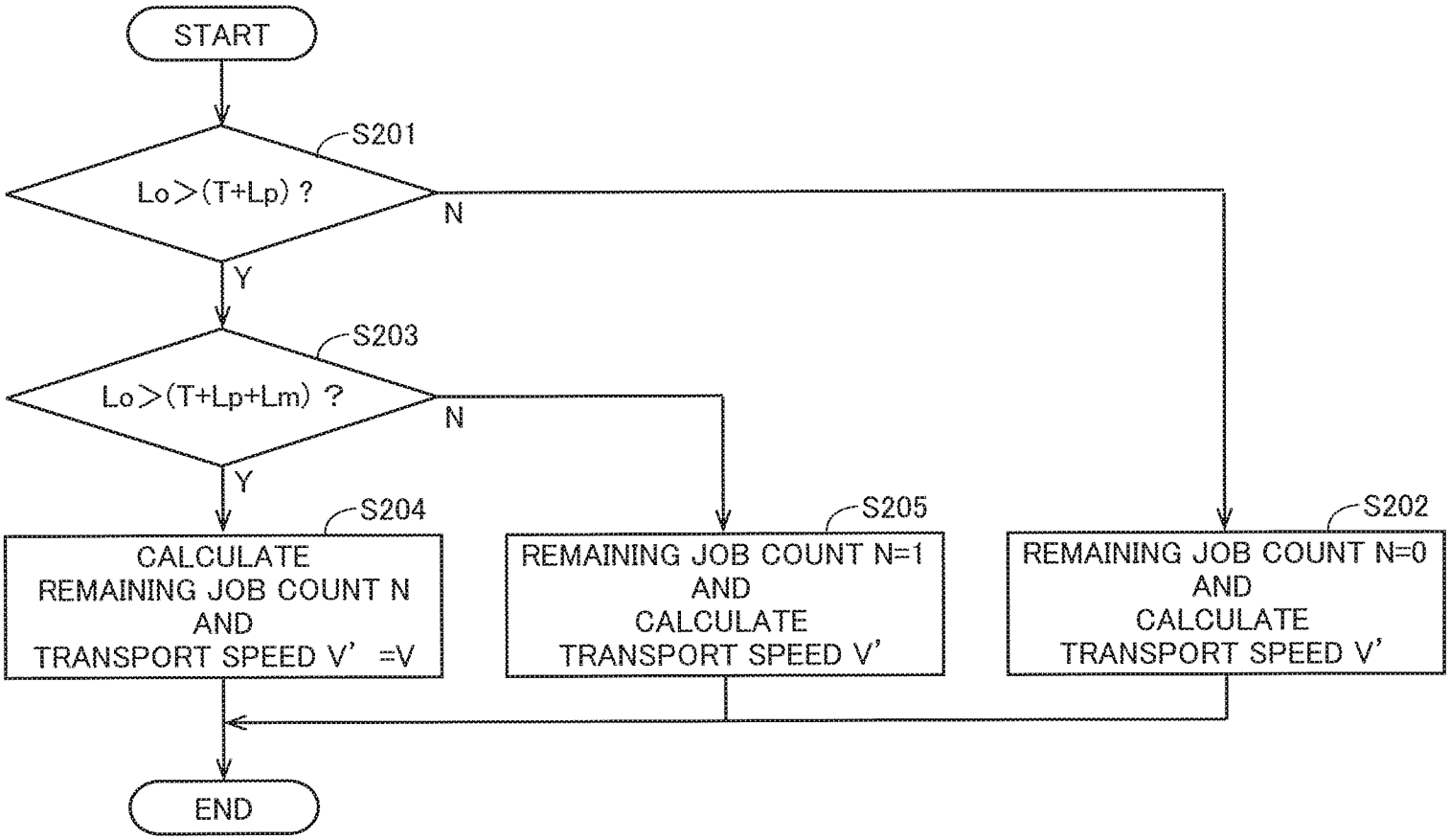
FIG. 5 is a flow diagram showing a procedure for a remaining job count calculation step according to the one embodiment.

Next, the suspension of the printing step in the printing apparatus 1 at the time of the detection of a splice part will be described with reference to FIGS. 3 to 5. FIG. 3 is a flow diagram showing a procedure for the suspension of the printing step at the time of the detection of a splice part according to the present embodiment. FIG. 4 is a view showing an example of the printing paper 9 after the end of the printing. FIG. 5 is a flow diagram showing a procedure for a remaining job count calculation step.

During the printing step in the printing apparatus 1, the recording heads 30 are placed in the printing position. Specifically, the distance between the lower surfaces of the recording heads 30 and the printing paper 9 having an ordinary thickness and placed on the recording region Rp is 1 mm, for example. For this reason, there is apprehension that a splice part 90 comes in contact with the lower surfaces of the recording heads 30 if the splice part 90 of the printing paper 9 passes under the recording heads 30 while the recording heads 30 remain placed in the printing position. The contact of the splice part 90 with the lower surfaces of the recording heads 30 might cause an ejection failure and a malfunction in the recording heads 30.

To prevent the ejection failure and the malfunction, this printing apparatus 1 suspends the printing step when the splice detector 40 detects the splice part 90. FIG. 3 shows a specific procedure therefor. After starting the printing step, the controller 10 judges whether the splice detector 40 has detected the splice part 90 or not (Step S101). If the splice detector 40 has not detected the splice part 90 in Step S101, the procedure returns to Step S101, and the controller 10 continues the printing step while monitoring whether the splice detector 40 has detected the splice part 90 or not.

During the execution of the printing step, a start position marker 91 and a unit image 92 are printed for each printing period T on the printing paper 9, as shown in FIG. 4.

The start position marker 91 is printed for ease of identification of the start position of each printing period T during the processing in the post-processing machine. Although the start position marker 91 is printed for each printing period T in the present embodiment, the present invention is not limited to this. The start position marker 91 need not be printed on the printing paper 9 or may be printed for only the printing period T including the most upstream unit image 92. Alternatively, a marker indicating the end position or the middle position of each printing period may be printed in place of the start position marker 91.

During the execution of the printing step, the controller 10 stores a last start position that is the start position of the last unit image 92 on the printing paper 9 at that point of time in the storage part 13 of the controller 10. That is, the storage part 13 has the last start position stored therein in the present embodiment. However, the last start position may be stored in the memory 12 of the controller 10.

Each time the printing of a new unit image 92 starts, the controller 10 updates the last start position stored in the storage part 13 to the start position of a new image period. The last start position P1 before the suspension of the printing step is shown in FIG. 4.

If the splice detector 40 has detected the splice part 90 in Step S101, the procedure proceeds to Step S102. Then, the controller 10 calculates a remaining job count N before suspension indicative of the number of unit images 92 recordable on the printing paper 9 during a time interval between that point of time and the suspension of the printing step, and an on-movement transport speed V' indicative of the transport speed of the printing paper 9 at the time of suspension of the printing (Step S102). A specific method of the calculation in Step S102 will be described later.

The calculation of the aforementioned values in Step S102 may be performed before the start of the printing on the printing paper 9. Specifically, the step of calculating the aforementioned values which corresponds to Step S102 may be previously performed after job data is inputted from outside to the controller 10 and before the printing on the printing paper 9 starts.

Subsequent to Step S102, the printing apparatus 1 performs the printing of remaining jobs (Step S103). Specifically, if it is judged in Step S102 that the remaining job count N before suspension is equal to 0 and if any unit image 92 is being printed, the printing is promptly stopped. If it is judged in Step S102 that the remaining job count N before suspension is equal to 1, the unit image 92 being printed at the time of detection of the splice part 90 is printed completely to the end, but a new unit image 92 is not printed. If it is judged in Step S102 that the remaining job count N before suspension is not less than 2, the unit image 92 being printed at the time of detection of the splice part 90 is printed completely to the end, and at least one unit image 92 corresponding to (N−1) period(s) is printed, following which the printing is stopped.

If the on-movement transport speed V' calculated in Step S102 differs from an ordinary on-printing transport speed V after the printing by means of the recording heads 30 is stopped, the transport speed of the printing paper 9 by means of the transport mechanism 20 is changed to the on-movement transport speed V'. Thus, the transport speed of the printing paper 9 is made lower than that during the printing. Then, the head moving mechanisms 31 are put into operation to shift the recording heads 30 from the printing position to the retracted position (Step S104).

Setting the remaining job count N and the on-movement transport speed V' to suitable values in Step S102 restrains the splice part 90 from reaching the recording region Rp before the completion of the movement of the recording heads 30 in Step S104. This restrains the splice part 90 from coming in contact with the recording heads 30.

After the completion of Step S104, the controller 10 changes the transport speed of the printing paper 9 by means of the transport mechanism 20 back to the on-printing transport speed V. Then, the controller 10 judges whether the splice part 90 has reached a predetermined retraction end position Ps or not, based on the position in which the splice detector 40 has detected the splice part 90 and the transport distance of the printing paper 9 inputted from the encoder rollers 221 (Step S105).

The retraction end position Ps in the present embodiment is downstream of the recording heads 30 and upstream of the UV lamp 50. Thus, whether the splice part 90 has reached a position downstream of the recording heads 30 or not is judged in Step S105. It is only necessary that the retraction end position Ps is downstream of at least the recording heads 30. The retraction end position Ps may be downstream of the UV lamp 50.

If the controller 10 judges that the splice part 90 has not reached the retraction end position Ps in Step S105, the procedure returns to Step S105, and the controller 10 goes on standby.

On the other hand, if the controller 10 judges that the splice part 90 has reached the retraction end position Ps in Step S105, the controller 10 puts the head moving mechanisms 31 into operation again to shift the recording heads 30 from the retracted position to the printing position (Step S106).

In Step S106, the controller 10 may move the recording heads 30 from the retracted position to the printing position while the transport of the printing paper 9 by means of the transport mechanism 20 is stopped. In Step S106, the controller 10 may also move the recording heads 30 from the retracted position to the printing position while transporting the printing paper 9 at a transport speed lower than that during the printing. This reduces the useless feed of the printing paper 9.

If the on-movement transport speed V' is lower than the on-printing transport speed V, the transport speed of the printing paper 9 by means of the transport mechanism 20 may be equal to the on-movement transport speed V' in Steps S104 to S106.

While the printing step is suspended in Steps S104 to S106, the controller 10 according to the present embodiment also stores a virtual last start position that is the last start position on the printing paper 9 into the storage part 13 if printing continues. In other words, the controller 10 causes a first virtual last start position P21 shown in FIG. 4 to be stored as the virtual last start position after printing period T from the last start position P1 before the suspension of the printing. Subsequently, the controller 10 updates a second virtual last start position P22 as a new virtual last start position. Thereafter, the controller 10 updates the virtual last start position in the same manner.

In the present embodiment, the printing of the start position markers 91 continues while the printing step is suspended in Steps S104 to S106, as shown in FIG. 4. The retracted position of the recording heads 30 in the present embodiment lies vertically above the printing position of the recording heads 30. This allows the printing of the start position markers 91 while the recording heads 30 are retracted. However, the distance between the printing paper 9 and the recording heads 30 in the retracted position is longer than that between the printing paper 9 and the recording heads 30 in the printing position. This causes imperfections such as misregistration as compared with the ordinary start position markers 91 and unclear patterns. In this manner, the printing of the start position markers 91 is performed, although imperfect, while the printing step is suspended. This allows an operator to roughly grasp the printing periods T when visually recognizing the printing paper 9.

After the movement of the recording heads 30 in Step S106 is completed, the controller 10 determines a printing restart position P3 at the time of restart of printing, based on a virtual last start position P2*n* at that point of time. Then, the controller 10 restarts the printing of the unit images 92 by means of the recording heads 30 from the printing restart position P3 (Step S107).

The printing restart position P3 shall be a position spaced the printing period T apart from the virtual last start position P2*n* in a downstream direction. Thus, the printing restart position P3 is a position an integral multiple of the printing period T apart from the last start position P1 before the suspension of the printing.

In this manner, the present embodiment causes the printing period before the suspension of the printing to coincide with the printing period after the restart of the printing. In other words, a difference between the periods of the image recording positions before and after the suspension of the printing step is restrained. This eliminates the step of adjusting the printing period on the printing paper 9 again in the post-processing machine for part of the printing paper 9 after the suspension of the printing when the post-processing machine processes the printing paper 9 after the printing. That is, the step of processing in the post-processing machine from part of the printing paper 9 before the suspension of the printing to part of the printing paper 9 after the restart of the printing is performed continuously without the need for the suspension of the operation during the use of the post-processing machine for the recognition of the printing period and the need for the provision of an apparatus for sensing the printing period after the restart of the printing in the post-processing machine.

Next, the step of calculating the remaining job count N before suspension and the on-movement transport speed V' in Step S102 will be discussed with reference to FIG. 5.

In Step S102, the controller 10 initially judges whether the distance Lo from the detection position of the splice detector 40 to an upstream end of the recording region Rp as measured in the transport direction is longer than the sum of the printing period T and the length Lp of the recording region Rp as measured in the transport direction or not (Step S201). If the controller 10 judges that the distance Lo is not greater than the distance (T+Lp) in Step S201, the procedure proceeds to Step S202.

While the unit image 92 being printed near the upstream end of the recording region Rp at the time of detection of the splice part 90 is printed completely to the end after the detection of the splice part 90, the printing paper 9 is transported downstream for the distance (T+Lp) that is the sum of the printing period T and the distance Lp at the maximum. If it is judge in Step S201 that Lo≤(T+Lp) and if the unit image 92 being printed near the upstream end of the recording region Rp at the time of detection of the splice part 90 is printed completely to the end, the splice part 90 reaches the recording region Rp during the printing. At this time, there is apprehension that the splice part 90 comes in contact with the recording heads 30. To prevent this, the remaining job count N is set to 0 in Step S202. Thus, the unit image 92 being printed is not completely printed to the end in Step S103, but the printing is promptly suspended.

If it is judged that Lo≤(T+Lp) and if there are at least two unit images 92 being printed in the recording region Rp, the printing of all of the unit images 92 is promptly suspended, but at least an upstream one of the unit images 92 may be printed completely to the end.

In Step S202, the on-movement transport speed V' is also set to a speed lower than the on-printing transport speed V, as required. For example, if the distance Lo is shorter than an on-movement transport distance Lm, the on-movement transport speed V' is set to a speed lower than the on-printing transport speed V. The on-movement transport distance Lm refers to a distance that the printing paper 9 travels while the recording heads 30 are moved from the printing position to the retracted position in Step S104 in the case where the printing paper 9 is transported at the on-printing transport speed V that is the transport speed of the printing paper 9 during the printing.

If it is judged in Step S201 that Lo>(T+Lp), the controller 10 then judges whether the distance Lo is longer than the sum of the printing period T, the length Lp of the recording region Rp as measured in the transport direction and the on-movement transport distance Lm or not (Step S203).

If it is judged in Step S203 that the distance Lo is longer than the sum of the printing period T, the length Lp and the on-movement transport distance Lm, the procedure proceeds to Step S204. While the unit image 92 being printed near the upstream end of the recording region Rp at the time of detection of the splice part 90 is printed completely to the end after the detection of the splice part 90, the printing paper 9 is transported downstream for the distance (T+Lp) that is the sum of the printing period T and the distance Lp at the maximum. Thereafter, when the recording heads 30 are moved while the on-printing transport speed V is maintained, the printing paper 9 is transported further downstream for the on-movement transport distance Lm.

Thus, if Lo>(T+Lp+Lm) and if the recording heads 30 are moved while the transport speed of the printing paper 9 is maintained at the on-printing transport speed V after the unit image 92 being printed at the time of detection of the splice part 90 is printed completely to the end, the splice part 90 does not reach the recording region Rp before the end of the movement of the recording heads 30. Thus, the on-movement transport speed V' is set to V in Step S204.

In Step S204, the integer part of the quotient of the distance (Lo−Lm) divided by the printing period T is defined as the remaining job count N. By calculating the remaining job count N in this manner, the splice part 90 does not reach the recording region Rp before the end of the movement of the recording heads 30 if the recording heads 30 are moved after the printing of the unit image 92 being printed at the time of detection of the splice part 90 and the subsequent unit image(s) 92 corresponding to (N−1) period(s). This achieves an increase in the number of unit images 92 printed on the printing paper 9 while restraining the splice part 90 from coming in contact with the recording heads 30.

On the other hand, if the controller 10 judges that the distance Lo is not longer than the sum of the printing period T, the length Lp and the on-movement transport distance Lm in Step S203, the procedure proceeds to Step S205. At this time, the distance Lo is as follows: (T+Lp)<Lo≤(T+Lp+Lm).

While the unit image 92 being printed near the upstream end of the recording region Rp at the time of detection of the splice part 90 is printed completely to the end after the detection of the splice part 90, the printing paper 9 is transported downstream for the distance (T+Lp) that is the sum of the printing period T and the distance Lp at the maximum. At this point of time, the splice part 90 does not reach the recording region Rp. Thus, the remaining job count N is set to 1 in Step S205.

Thereafter, when the recording heads 30 are moved while the on-printing transport speed V is maintained, the printing paper 9 is transported further downstream for the on-movement transport distance Lm. Thus, the splice part 90 reaches the recording region Rp before the end of the movement of the recording heads 30. It is hence necessary that the transport speed of the printing paper 9 is set to a speed lower than the on-printing transport speed V after the unit image 92 being printed near the upstream end of the recording region Rp at the time of detection of the splice part 90 is printed completely to the end. In Step S205, the on-movement transport speed V' lower than the on-printing transport speed V is calculated in accordance with the length Lo. This restrains the splice part 90 from reaching the recording region Rp before the end of the movement of the recording heads 30.

In this manner, the calculation of the suitable remaining job count N and the suitable on-movement transport speed V' in the remaining job count calculation step in Step S102 reduces waste of the printing paper 9 while restraining the splice part 90 from coming in contact with the recording heads 30.

<3. Modifications>

While the one embodiment according to the present invention has been described hereinabove, the present invention is not limited to the aforementioned embodiment.

In the aforementioned embodiment, the on-movement transport speed V' is made equal to the on-printing transport speed V in Step S204 if the distance Lo is sufficiently long. The present invention, however, is not limited to this. In the step of switching from the printing position to the retracted position in Step S104, the printing paper 9 may be transported at a transport speed lower than the on-printing transport speed V if the distance Lo is sufficiently long. This further shortens a printing suspension region on the printing paper 9.

In the aforementioned embodiment, the recording heads 30 are moved for the purpose of switching the relative position of the recording heads 30 and the recording region Rp to the printing position and to the retracted position. The present invention, however, is not limited to this. The platen rollers 222 constituting the recording region Rp may be moved for the purpose of switching the relative position of the recording heads 30 and the recording region Rp.

The printing apparatus according to the aforementioned embodiment prints images on the printing paper 9 serving as the recording medium. However, the printing apparatus according to the present invention may be configured to print a pattern of images and the like on a sheet-like recording medium other than general paper (for example, a film made of resin and the like).

The components described in the aforementioned embodiment and in the modifications may be consistently combined together, as appropriate.

REFERENCE SIGNS LIST

1 Printing apparatus
9 Printing paper
10 Controller
12 Memory
13 Storage part
20 Transport mechanism
30 Recording heads
31 Head moving mechanisms
40 Splice detector
50 UV lamp
90 Splice part
91 Start position markers
92 Unit images
221 Encoder rollers
222 Platen rollers

The invention claimed is:

1. An image recording apparatus for printing each of a plurality of unit images for each predetermined printing period on an elongated strip-shaped recording medium while transporting said recording medium, said image recording apparatus comprising:

a transport part for transporting said recording medium along a transport path, said transport part configured to change a transport speed of said recording medium;

a recording head for ejecting droplets onto said recording medium disposed in a recording region on said transport path to print an image on said recording medium;

a detector disposed upstream of said recording head and for detecting a thick part of said recording medium, said thick part being thicker than other parts of said recording medium;

a relative position switching part for switching the relative position of said recording head and said recording region to a printing position and to a retracted position;

a storage part for storing a last start position that is a start position of the last one of said unit images on said recording medium; and a controller for controlling the parts, in response to detection of said thick part by said detector, said controller calculating a remaining job count N indicative of a number of unit images recordable on said recording medium during a time interval between the detection of said thick part and suspension of a printing step and an on-movement transport speed V' indicative of the transport speed of said recording medium at the time of suspension of the printing step based on a distance Lo from a detection position of said thick part to an upstream end of said recording region as measured in a transport direction, a printing period T, and a length Lp of said recording region as measured in the transport direction, with said remaining job count N being equal to 0, said controller stopping the printing step by means of said recording head promptly, and with said remaining job count N being equal to or greater than 1, said controller stopping the printing step by means of said recording head after one of said unit images being printed at the time of detection of said thick part by said detector is printed completely to the end and said unit images corresponding to an (N−1) period are printed completely to the end, said controller switching the relative position of said recording head and said recording region to the retracted position by means of said relative position switching part before said thick part reaches said recording region, said controller, after said thick part passes through said recording region, switching the relative position of said recording head and said recording region to the printing position by means of said relative position switching part, and starting the printing of new one of said unit images by means of said recording head from a position on said recording medium, the position being separated by an integral multiple of said printing period from said last start position.

2. The image recording apparatus according to claim 1, wherein:

said storage part stores therein a virtual last start position while the printing by means of said recording head is stopped, said virtual last start position becoming said last start position on said recording medium if the printing continues; and said controller restarts the printing of said unit images by means of said recording head from the position an integral multiple of said printing period apart from said last start position, based on said virtual last start position, when starting the printing of the new one of said unit images after the printing is stopped.

3. The image recording apparatus according to claim 1, wherein said controller makes the transport speed of said recording medium by means of said transport part lower than that during the printing and switches the relative position of said recording head and said recording region to the retracted position by means of said relative position switching part before said thick part reaches said recording region and after the printing by means of said recording head is stopped.

4. The image recording apparatus according to claim 1, wherein said controller switches the relative position of said recording head and said recording region to the printing position by means of said relative position switching part while the transport of said recording medium by means of said transport part is stopped after said thick part passes through said recording region.

5. The image recording apparatus according to claim 1, wherein said relative position switching part moves said recording head to thereby switch the relative position of said recording head and said recording region.

6. The image recording apparatus according to claim 1, wherein:

said transport part includes a plurality of platen rollers extending in a substantially horizontal direction orthogonal to said transport path and constituting said recording region; and said relative position switching part moves said platen rollers to thereby switch the relative position of said recording head and said recording region.

7. The image recording apparatus according to claim 1, wherein every time the printing of new one of said plurality of unit images starts, said controller updates said last start position stored in said storage part by replacing a previously stored last start position with a start position of a new image period corresponding to the new one of said plurality of unit images.

8. The image recording apparatus according to claim 1, wherein:

if said distance Lo is equal to or less than the sum of said printing period T and said length Lp, said controller defines said remaining job count N as 0; and if said distance Lo is greater than the sum of said printing period T and said length Lp, the integer part of the quotient of a difference divided by said printing period T is defined as said remaining job count N, said difference being obtained by subtracting a distance Lm from said distance Lo.

9. A method of recording an image, said method printing each of a plurality of unit images for each predetermined printing period by ejecting droplets from a recording head onto an elongated strip-shaped recording medium disposed in a recording region on an transport path while transporting said recording medium along said transport path, said method comprising the steps of:

a) storing a last start position that is a start position of the last one of said unit images on said recording medium;

b) detecting a thick part of said recording medium in a position upstream of said recording region, said thick part being thicker than other parts of said recording medium, said step b) being performed after said step a);

c) calculating a remaining job count N indicative of a number of unit images recordable on said recording medium during a time interval between detection of said thick part and suspension of a printing step and an on-movement transport speed V' indicative of the transport speed of said recording medium at the time of suspension of the printing step based on a distance Lo from a detection position of the thick part to an upstream end of said recording region as measured in a transport direction, a printing period T, and a length Lp of said recording region as measured in the transport direction, said step c) being performed after said step b);

d) stopping the printing step by means of said recording head after recording of said unit images corresponding to said remaining job count N including one of said unit images being recorded at the time of detection of said thick part, said step d) being performed after said step c);

e) switching the relative position of said recording head and said recording region from a printing position to a retracted position before said thick part reaches said recording region, said step e) being performed after said step d);

f) switching the relative position of said recording head and said recording region from said retracted position to said printing position, said step f) being performed after said step e and after said thick part passes through said recording region; and g) printing new one of said unit images from a position on said recording medium, the position being separated by an integral multiple of said printing period from said last start position, said step g) being performed after said step f) wherein, if said remaining job count N is equal to 0 in said step c), the printing step by means of said recording head is stopped promptly in said step e), and if said remaining job count N is equal to or greater than 1 in said step c), one of said unit images being printed at the time of detection of said thick part is printed completely to the end and said unit images corresponding to an (N−1) period are printed completely to the end before the printing step is stopped in said step d).

10. The method according to claim 9, wherein in said step e), said on-movement transport speed V' lower than a transport speed V during the printing is employed as the transport speed of said recording medium, and the relative position of said recording head and said recording region is switched from said printing position to said retracted position.

11. The method according to claim 9, wherein in said step f), the relative position of said recording head and said recording region is switched from said retracted position to said printing position while the transport of said recording medium is stopped.

12. The method according to claim 9, wherein if said distance Lo is equal to or less than the sum of said printing period T and said length Lp, said remaining job count N is defined as 0 in said step c); and if said distance Lo is greater than the sum of said printing period T and said length Lp, said controller defines the integer part of the quotient of a difference divided by said printing period T as said remaining job count N in said step c), said difference being obtained by subtracting a distance Lm from said distance Lo.

* * * * *